US009488037B2

(12) United States Patent
McGee et al.

(10) Patent No.: US 9,488,037 B2
(45) **Date of Patent: *Nov. 8, 2016**

(54) SONIC OIL RECOVERY APPARATUS FOR USE IN A WELL

(71) Applicants: Rick Alan McGee, Houston, TX (US); Michael Fraim, Corrales, NM (US)

(72) Inventors: Rick Alan McGee, Houston, TX (US); Michael Fraim, Corrales, NM (US)

( * ) Notice: Subject to any disclaimer, the term of this patent is extended or adjusted under 35 U.S.C. 154(b) by 16 days.

This patent is subject to a terminal disclaimer.

(21) Appl. No.: 14/680,537

(22) Filed: Apr. 7, 2015

(65) Prior Publication Data

US 2015/0275628 A1 Oct. 1, 2015

Related U.S. Application Data

(63) Continuation-in-part of application No. 13/570,759, filed on Aug. 9, 2012, now Pat. No. 9,010,420, which is a continuation-in-part of application No. 13/212,595, filed on Aug. 18, 2011, now abandoned.

(60) Provisional application No. 61/377,713, filed on Aug. 27, 2010.

(51) Int. Cl.
*E21B 43/00* (2006.01)
*E21B 28/00* (2006.01)

(52) U.S. Cl.
CPC ..... *E21B 43/003* (2013.01); *E21B 28/00* (2013.01)

(58) Field of Classification Search
CPC ..... E21B 43/003
USPC ..... 166/249, 177.1, 171.2; 367/31, 35; 181/102, 104, 105, 108, 113, 160
See application file for complete search history.

(56) References Cited

U.S. PATENT DOCUMENTS

| | | | |
|---|---|---|---|
| 2,700,422 | A | 1/1955 | Bodine et al. |
| 3,754,598 | A | 8/1973 | Holloway et al. |
| 6,015,010 | A | 1/2000 | Kostrov |

*Primary Examiner* — Kenneth L Thompson
*Assistant Examiner* — Steven MacDonald
(74) *Attorney, Agent, or Firm* — Egbert Law Offices, PLLC

(57) ABSTRACT

A sonic oil recovery apparatus for use in a well having a casing therein, has an injector tubing adapted to extend within an interior of the casing and a resonator tube affixed to or within the injector tubing. The resonator tube having an interior flow pathway so as to allow a fluid to flow therethrough from the injector tubing. The resonator tube is suitable for transmitting an acoustic signal of greater than 30 Hz therefrom. The resonator tube has at least two orifice plates formed therein. The orifice plates include an upper orifice plate and a lower orifice plate. The orifice of the upper orifice plate has a diameter greater than a diameter of the lower orifice plate.

20 Claims, 16 Drawing Sheets

SONIC OIL RECOVERY APPARATUS FOR USE IN A WELL

CROSS-REFERENCE TO RELATED APPLICATIONS

The present application is a continuation-in-part of U.S. patent application Ser. No. 13/570,759, filed on Aug. 9, 2012, and entitled "Sonic Oil Recovery Apparatus for Use in a Well", presently pending. U.S. patent application Ser. No. 13/570,759 claims priority from U.S. patent application Ser. No. 13/212,595, filed on Aug. 18, 2011, and entitled "Sonic Enhanced Oil Recovery System and Method", currently abandoned. U.S. patent application Ser. No. 13/212,595 claimed priority from U.S. Provisional Patent Application Ser. No. 61/377,713, filed on Aug. 27, 2010.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the enhanced recovery of crude oil from zones or formations within a well. More particularly, the present invention the relates to the use of acoustic energy to enhance water injection techniques. Additionally, the present invention relates to the production of acoustic signals through the force of a fluid flowing through the injector tubing.

2. Description of Related Art Including Information Disclosed Under 37 CFR 1.97 and 37 CFR 1.98.

The production of crude oil from a formation is initially supported by the expansion of fluids in the pore system and then, as the reservoir pressure falls below the bubble point of the oil, the expansion of solution gas provides pressure support. This phase of the reservoir life is called primary recovery. Some reservoirs are connected to an aquifer and the flow of water from the aquifer provides pressure support to displace the crude oil to the producing wells.

As the production rate of crude oil declines under primary recovery mechanisms, secondary oil recovery techniques are used to provide pressure support for the oil reservoir. The most popular technique is water injection into the oil zone and is called water flooding. For high viscous oils, steam flooding is used to provide pressure support, reduce the thermal viscosity and increase the mobility of the oil. For lighter oils, gas injection can be used to induce gravity drainage of the oil toward the structurally lower production wells and this method is called gas assisted gravity drainage; however, if steam is the injected gas, it is called steam assisted gravity drainage.

In order to improve the ability to recover oil above that normally possible with secondary recovery techniques, tertiary oil recovery techniques are used. A tertiary method commonly used in zones being water flooded includes the use of diversion agents such as polymers to increase water viscosity and plug off swept zones to improve vertical and horizontal sweep efficiencies. To mobilize residual oil in the areas already swept by water, surfactants and caustic agents are mixed with the injected water to reduce surface tension, but absorption of the expensive surfactants on clay particles limits the application to cleaner formations. This type of flood is called an alkaline, surfactant and polymer flood (ASP flood).

An experimental tertiary oil recovery technique is the use of low frequency acoustic energy to increase oil recovery in water floods and natural water drive oil reservoirs. Seismic sources (6-40 Hz) have been pilot tested on shallow oil zones in Russia with documented success on high water cut wells where the oil cut increased from 1-2% to 8-12% while the water production rate remained constant. This increased oil cut returned to normal over a one to four week period following termination of the seismic stimulation.

U.S. Pat. No. 2,700,422 by Bodine describes using seismic (1 to 30 Hz) vibration to stimulate the oil producing formation. A standing wave in a fluid or metal bar is used to stimulate the formation with a surface source or a standing tube wave is used to stimulate the formation with a down hole source. The major shortcoming with this constant frequency acoustic stimulation method in natural sediments is that the sonic energy can reflect away from the oil formation or it can attenuate before reaching the oil formation. Field trials using various transmission forms of the method show little or no effect on oil production due to the acoustic energy not reaching the oil formation.

U.S. Pat. No. 6,015,010 extends the Bodine method by using a down hole pump to generate a very high pressure pulse or shock wave in the well bore. The shock wave produces a broad banded, low frequency (10 to 250 Hz) acoustic pulse. Field trials show the source frequency band can overlap a guided wave frequency in the oil formation and this single frequency can be measured more than 1000 ft away from the source. Field production tests using the source have shown a decrease in oil decline rate.

Sonic stimulation conducted for one hour to several days (1-3 kHz) in well bores of producing wells has shown a permanent increase in oil production over the life of the wells. This effect is attributed to removal of skin damage in the near wellbore area by mobilizing clay fines, liquefying paraffin build up and emulsifying solid asphaltenes back into the liquid oil phase.

Ultrasonic treatment (16 to 30 kHz) of perforated intervals, gravel packs and slotted liners in producing wells has been used to remove carbonate and sulfate scale build up. The ultrasonic treatment process creates cavitations that fracture the scale into particles that are then produced to the surface along with the fluids. Ultrasound usually attenuates within several wellbore diameters from the casing or liner surface, thus the usefulness of ultrasonic stimulation is limited to the near well bore area.

Core tests with seismic frequencies (6-100 Hz) have shown improved or accelerated oil recovery by coalescing individual oil droplets into a continuous oil phase, reducing capillary force as a result of the core becoming more water wet, reducing interfacial tension between heavy oil and brine, and releasing solution gas from the liquid oil phase even though the average reservoir pressure is above the bubble point. The release of solution gas can cause the effect of seismic stimulation of the reservoir to last for weeks while the gas is being dissolved back into the oil phase.

U.S. Pat. No. 3,754,598 shows using low frequency (0.001 to 25 Hz) oscillatory pressure injection to increase the sweep efficiency of a pattern water flood or surfactant flood. The amplitude of the pressure pulse would range from 10 p.s.i. to fracture pressure of the reservoir. For synthetic cores with uniform permeability and porosity, oscillatory pressure injection can increase injectivity by a factor of 2.5 and decrease residual oil saturation by 10%. While core tests have shown positive oil recovery results for acoustic frequencies ranging from 30 Hz to 40 kHz, field pilot tests have shown mixed results. In pilot tests that have failed using surface seismic sources, hydrophone recordings showed that either the formation was too deep or there was a major reflection or absorption layer between the source and the target formation. In pilot tests that have failed using well bore acoustic sources, hydrophone recordings have shown that the source frequency output had attenuated 30 decibels in the offset producing wells.

Cross well bore tomography of oil formations shows that specific frequencies resonate in the reservoir without attenuation while the majority of other frequencies attenuate 30 decibels in an offset well. Earth noise usually starts around −40 decibels (based on zero at the acoustic tool source) for low frequencies and core tests reveal that acoustic vibrations should measure 20 decibels above noise in order to have an effect on residual oil saturation. Cross well bore tomography also shows that guided waves can be stopped or reflected out of zone by faults and that thin shale lenses can increase the attenuation.

It is an object of the present invention to provide a sonic oil recovery apparatus that enhances oil recovery in production zones.

It is another object of the present invention to provide a sonic oil recovery apparatus which reduces electrical power requirements due to an increase in injectivity.

It is another object of the present invention to provide a sonic oil recovery apparatus which reduces the pressure requirements of the introduced fluid into the well.

It is a further object of the present invention to provide a sonic oil recovery apparatus which increases the injectivity of the fluid into the well.

It is a further object of the present invention to provide a sonic oil recovery apparatus that reduces scale build up on the piping.

It is still a further object of the present invention to provide a sonic oil recovery apparatus in which water, or other fluid, can be injected at a higher rate and at lower pressures.

It is still a further object of the present invention to provide a sonic oil recovery apparatus which can be used on various types of formations.

It is a further object of the present invention to provide a sonic oil recovery apparatus that can transmit a resonate frequency band to a nearby producing well without excessive attenuation from faults, pinch-outs, or other significant rock matrix changes.

It is a further object of the present invention to provide a sonic oil recovery apparatus which enhances heavy oil production by fluidizing sand in worm holes and by reducing oil viscosity.

It is a further object of the present invention to provide a sonic oil recovery apparatus which enhances oil production from a carbon dioxide flood by increasing the gravity segregation rate.

It is a further object of the present invention to provide a sonic oil recovery apparatus which improves sweep of surfactant and polymer floods by enhancing fluid mixing in dead end pore spaces, increasing absolute permeability in low permeability zones and preventing polymer build up in the near wellbore area.

It is still a further object of the present invention to provide a sonic oil recovery apparatus which minimizes turbulence in the fluid flow.

These and other objects and advantages of the present invention will become apparent from a reading of the attached specification and appended claims.

BRIEF SUMMARY OF THE INVENTION

The present invention is a sonic oil recovery apparatus for use in a well. This sonic oil recovery apparatus has an injector tubing suitably extending interior of the casing of the well and a resonator tube affixed to or within the injector tubing. The resonator tube has an interior flow pathway so as to allow a fluid to flow therethrough from the injector tubing. The resonator tube is suitable for transmitting an acoustic signal of greater than 30 Hz therefrom. Preferably, the acoustic signal is between 600 and 1800 Hz.

In the preferred embodiment of the present invention, the resonator tube has at least two orifice plates formed therein. The orifice plates are arranged in generally spaced relationship to each other. The orifice plates have orifices arranged in coaxial relationship. The orifice of an upper orifice plate has a diameter greater than a diameter of an orifice of a lower orifice plate. The diameter of the orifice of one of the orifice plates is approximately 1.1 to 2 times the diameter of the orifice of the orifice plate positioned therebelow.

In the preferred embodiment, there are only two orifice plates. One of the orifice plates has a thickness greater than the thickness of the other orifice plate. The orifice plates are spaced by no more than one inch from each other. The orifice plates have a thickness of greater than 3/16 inch.

Each of the orifice plates has an outer diameter of between 1.2 and 5.6 times a diameter of the respective orifice thereof. The orifice plates are arranged in spaced parallel relationship to each other. The resonator tube has at least one spacer positioned between the pair of orifice plates. The spacer is an annular member having a contact point extending vertically therefrom. This contact point is suitable for contacting a surface of the orifice plate.

The resonator tube can have a frustoconical member extending from a bottom thereof. This frustoconical member has a narrow diameter at the bottom of the resonator tube. The frustoconical member has a wide diameter suitable for positioning adjacent an inner wall of the casing. In one embodiment, the resonator tube can have a tubular extension extending downwardly therefrom. This tubular extension is positioned below the orifice plates. In another embodiment, the tubular extension has a plurality of exit holes extending radially through a wall of the tubular extension adjacent the orifice plates. The tubular extension, in this embodiment, has a closed end opposite the orifice plates.

The resonator tube can be received interior of the injector tubing and extends outwardly beyond a lower end of the injector tubing. A landing nipple is interposed between an outer surface of the resonator tube and an inner wall of the injector tubing. A packer can be affixed to an outer surface of the injector tubing. The packer is suitable for engaging with an inner wall of the casing. The packer is positioned above the resonator tube. A bridge plug can be positioned below the resonator tube and, ideally, positioned below the recovery formation. The bridge plug will extend and seal against the inner walls of the casing.

Within the concept of the present invention, the resonator tube is suitable for transmitting an acoustic signal approximately equal to a resonant frequency of the recovery zone of the well.

The resonator tube can further include a solid state acoustic resonator therein. This acoustic resonator has an electrical power supply connected thereto. The acoustic resonator can be of a material selected from either a magneto restrictive material and a piezolelectric material.

The foregoing Summary of the Invention section is intended to describe generally the elements of the preferred embodiments of the present invention. It is understood that variations to these preferred embodiments can be made within the scope of the present invention. This section is not intended, in any way, to be limiting of the scope of the present invention. The present invention should only be limited by the following claims and their legal equivalents.

DETAILED DESCRIPTION OF THE INVENTION

Figure 1:
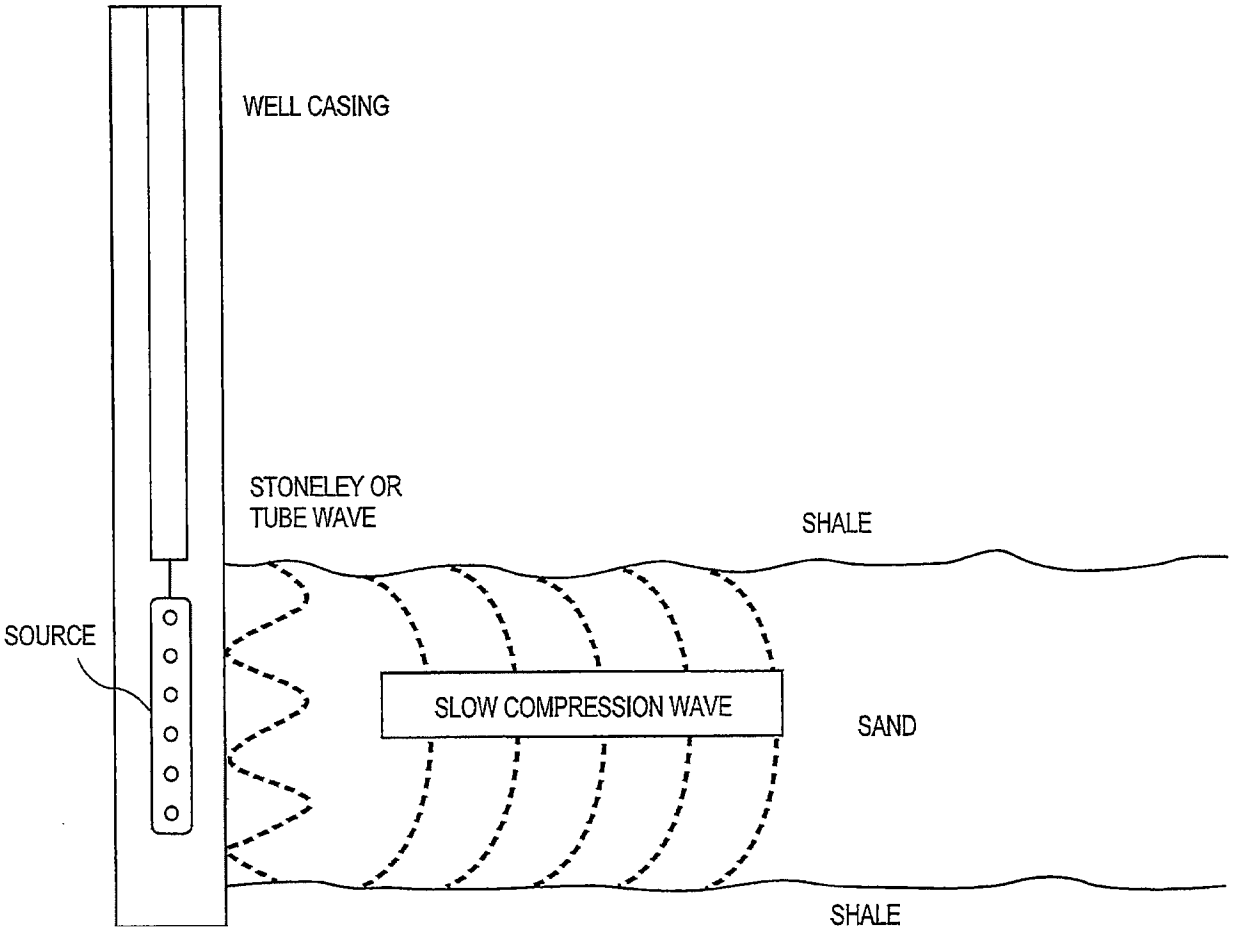
FIG. 1 is a cross-sectional view showing a solid state sonic stimulation device as utilized across a formation.

Referring to FIG. 1, there is shown The main purpose of the invention is to use sonic stimulation to reduce the boundary layer effects between oil and water in the pore and between oil and solid surface of the pore. On a microscopic scale, during sonic stimulation, one mode is that the fluid moves in-phase with the rock matrix and the other mode is that the fluid moves out of phase with the rock matrix for maximum fluid shear against the pore surface. For high viscosity, heavy crude oils, the in-phase mode is prominent due to the viscous drag force exceeding the force required to accelerate the oil droplet. For low viscosity fluids such as water or gas, the out of phase mode is prominent. For solid tars or bitumen in the rock matrix, there is no second fluid compression wave mode.

On a core size rock sample, sonic stimulation can reduce surface tension between oil and the core matrix and reduce interfacial tension between oil and water with the overall effect seen as a change in wetability of the core (more water wet) and a reduction in residual oil. So, as the water or gas saturation increases in the rock matrix, the shear effect from sonic stimulation increases and helps emulsify the oil droplets in the displacing water phase, thus reducing residual oil saturation.

Sonic stimulation can increase water injectivity by reducing scale damage and increasing relative permeability by reducing residual oil in the near well bore volume. Sonic stimulation can also increase oil productivity by reducing fines damage around the producing well bore and mobilizing residual oil within the drainage radius. Heat generated from electrical losses and gas bubble compression will heat the oil in and near the well bore volume and reduce oil viscosity.

As shown in FIG. 1 the acoustic energy produced from the sonic source can be contained in the target formation if the frequency band is chosen to resonate within the target formation or internally reflect off the bounding shale layers. For fluid coupled acoustic tools, the Stoneley or tube wave generation within the target formation will improve the slow compression wave mode conversion or coupling. The fluid coupling between the sonic source and the target formation can be improved by increasing perforation density or size, hydraulically fracturing the formation, or completing in open hole with or without under reaming.

Figure 2A:
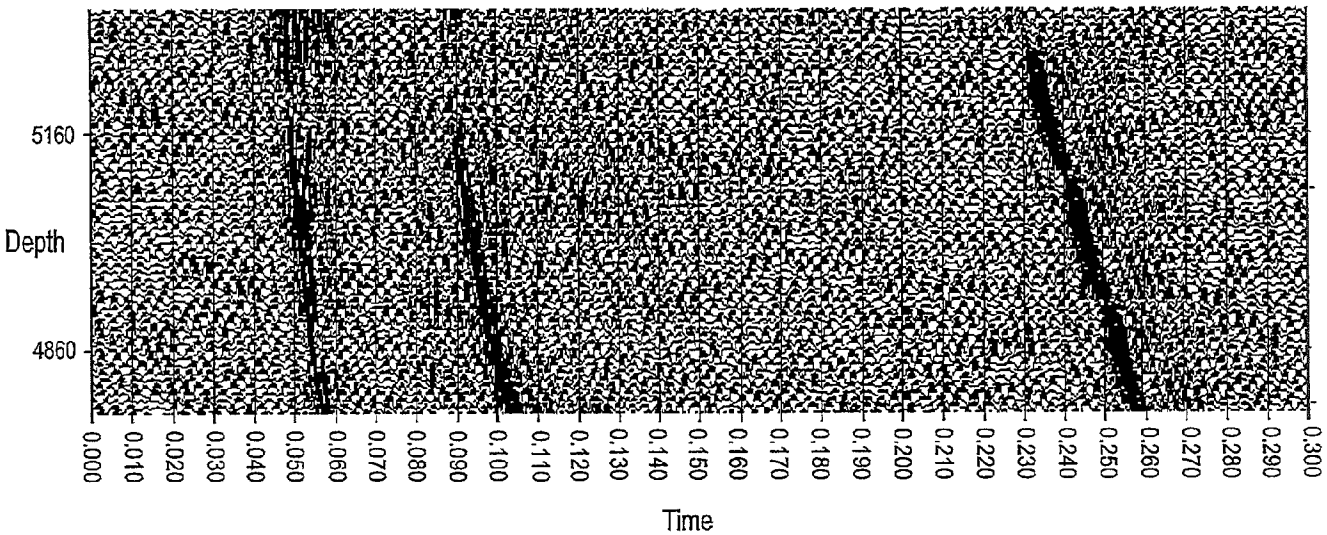
FIG. 2A is a raw cross well bore tomography image with a common receiver plotted against depths and time.
Figure 2B:
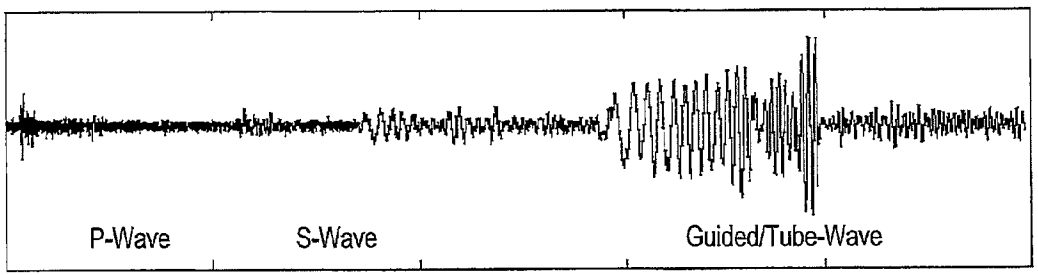
FIG. 2B is a single trace plotted against amplitude and time showing, in particular, P-Waves (compression), F-Waves (shear), and guided/tube waves (slow compression).

To acquire accurate measurements of frequencies and velocities in the target formation and surrounding strata, cross well bore tomography is shot between wells in the section of the oil field of interest. FIG. 2 shows a common receiver gather for depths ranging from 4800 ft to 5300 ft and a single trace at 4932 ft. The three wave forms highlighted are the compression wave, the shear wave and the guided/tube wave. The fastest acoustic wave arrival is the compression wave that has a velocity of the rock matrix. The shear wave is the next arrival along with reflections from layer boundaries. The noise in the cross well bore image surrounding the compression and shear wave arrivals is generated from previous acoustic pulses and down hole equipment from other wells in the field.

The guided, slow compression and tube waves usually arrive at 2 to 4 time intervals after the shear wave arrival time. These sets of waves are coupled to the fluid in the pore space and have velocities equal to or slower than the fluid velocity. The sonic source is swept through the lower frequencies to find the guided wave modes in the formation. The best guided wave mode for residual oil production is where the acoustic energy traveling in the fluid is out of phase to the acoustic energy traveling in the rock matrix.

This out of phase movement between the rock and fluid creates a shear force on the boundary layer of fluid next to the pore surface. With acoustic strain rates exceeding $10^{-6}$ seconds, the shear force exceeds the surface tension or interfacial tension force between the oil and water. With the acoustic energy canceling the surface tension force, the oil droplet can move between pores based on the pressure gradient created by the production wells draining the reservoir.

Figure 3:
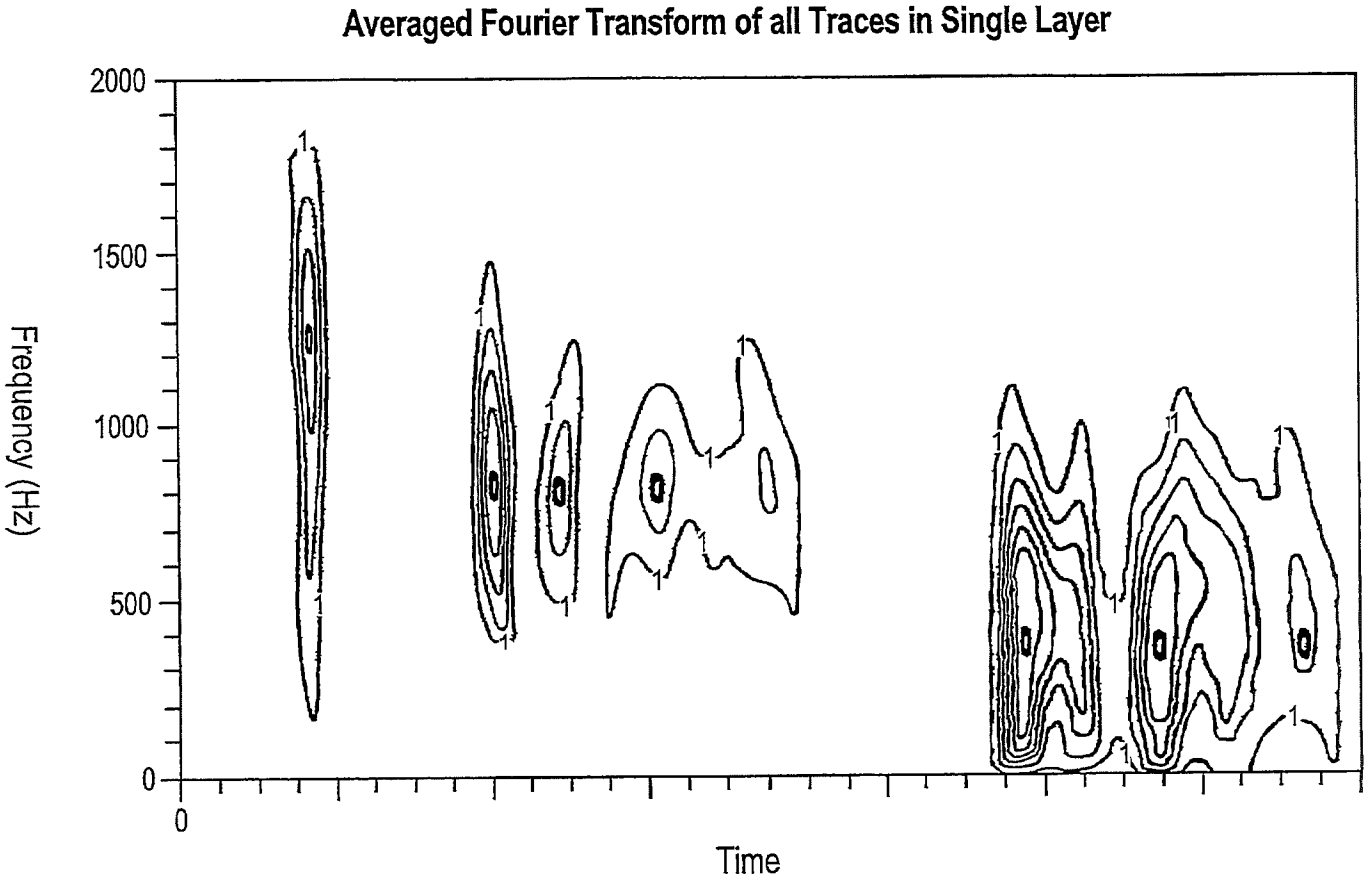
FIG. 3 shows an average Fourier Transform of all traces in a single layer in which noise has been removed for clarity.

FIG. 3 shows the Fourier transform of a single arrival time trace averaged over all the traces for a single reservoir layer. The compression wave (P-Wave) arrivals show an amplitude peak at 1230 Hz, but there is significant acoustic energy that mode converted to a tube wave before it was recorded at the hydrophone in the receiving well. The shear wave (S-Wave) arrivals have a peak amplitude around 820 Hz. Reflected shear waves from other layers have altered their frequency band as they traveled into this layer.

The guided, slow compression and tube waves show an amplitude peak at 385 Hz. The frequencies above 600 Hz in the contour plot around the peak are probably other shear wave reflections while the frequencies below 100 Hz are probably Stoneley waves generated in the well bore of the receiving well. There is a low signal to noise ratio at these long record times due to multiple reflections in the reservoir and tube wave reflections in the well bore.

Figure 4:
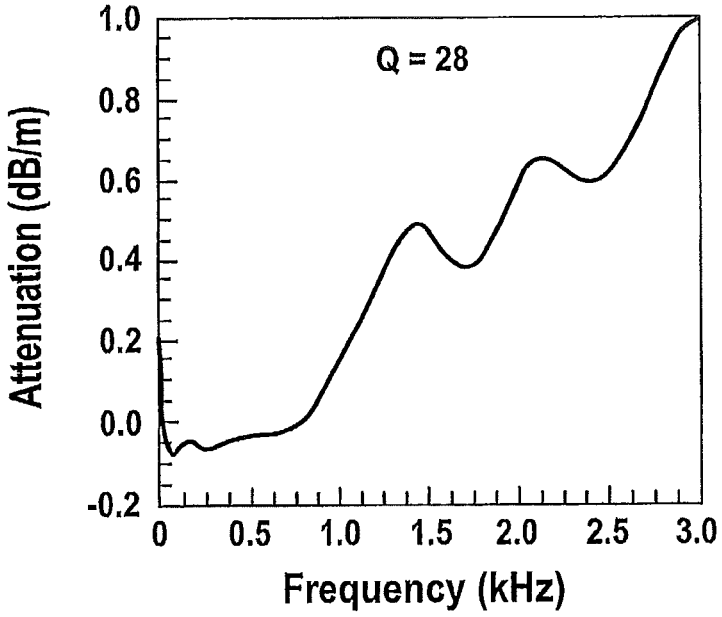
FIG. 4 is a graph of a typical attenuation curve shape for a single layer with a Q-factor of 28.

FIG. 4 shows the guided wave and slow compression wave attenuation curve for a layer with a Q-factor of 28. The negative values on the attenuation curve from 30 to 790 Hz show the layer is trapping higher frequency (1-3 kHz) acoustic energy and attenuating it into the lower frequency band. The two small dimples at 80 Hz and 190 Hz show the first out of phase and first in-phase guide wave modes. The 80 Hz out of phase guided wave mode would be best for a production well because the acoustic pulse tends to pump fluid towards the source. The actual acoustic source should be swept from 70 to 90 Hz. The 190 Hz in-phase guided wave mode would be best for an injection well because the acoustic pulse tends to pump fluid away from the source. The actual source could be swept from 170 to 210 Hz.

Figure 5:
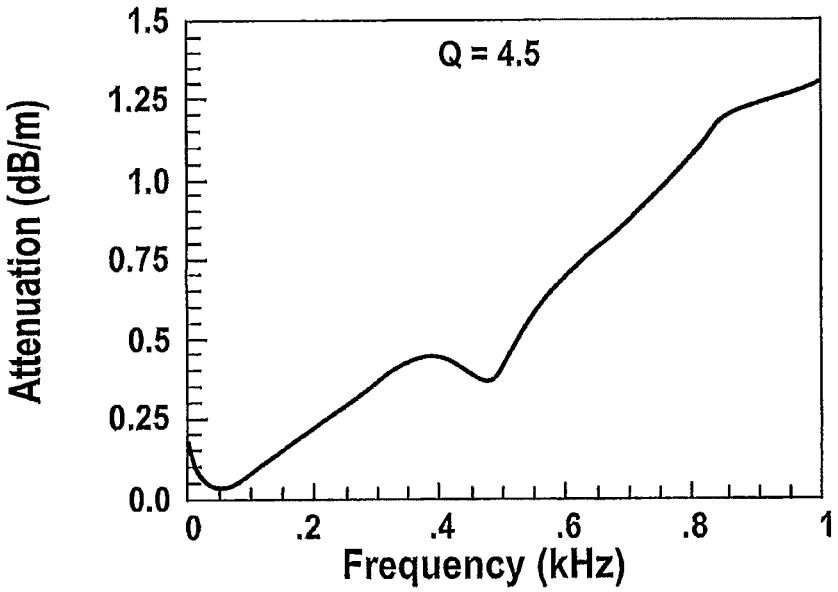
FIG. 5 is a graph of a typical attenuation curve shape for a single layer with a Q-factor of 4.5.

FIG. 5 shows the guided wave and slow compression wave attenuation curve for a layer with a Q-factor of 4.5. This low Q-factor layer would represent a high permeability, high porosity sandstone bounded by a low-permeability siltstone in a transgressive or regressive marine strata sequence. Notice the slow compression wave resonance at 52 Hz and the 'leaky' guided wave resonance at 490 Hz. Stimulation of this reservoir would be more effective with multiple sources due to the leakage of acoustic energy into the bounding layers.

Figure 6:
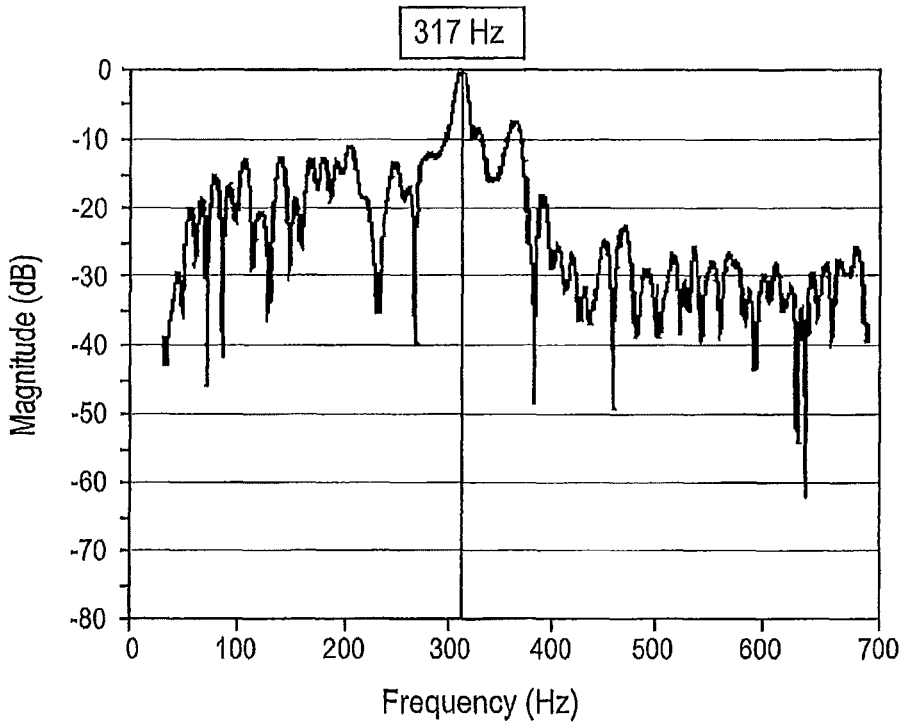
FIG. 6 is a graph of a Fourier Transform for a single trace of a guided slow compression wave or tube wave in a thick sand layer.

For thick sandstones bounded by thick shale layers, the guided wave frequency band is very sharp due to negative attenuation concentrating acoustic energy into the central guided wave frequency as shown in FIG. 6. The central guided wave frequency for this cross well bore tomography example is 317 Hz. There are a number of sharp troughs in the frequency curve from 80 Hz to 390 Hz and these troughs can be resolved with layer modeling of the cross well bore tomography data. The acoustic source should sweep between 300 to 340 Hz to stimulate the oil zone in FIG. 6.

Figure 7:
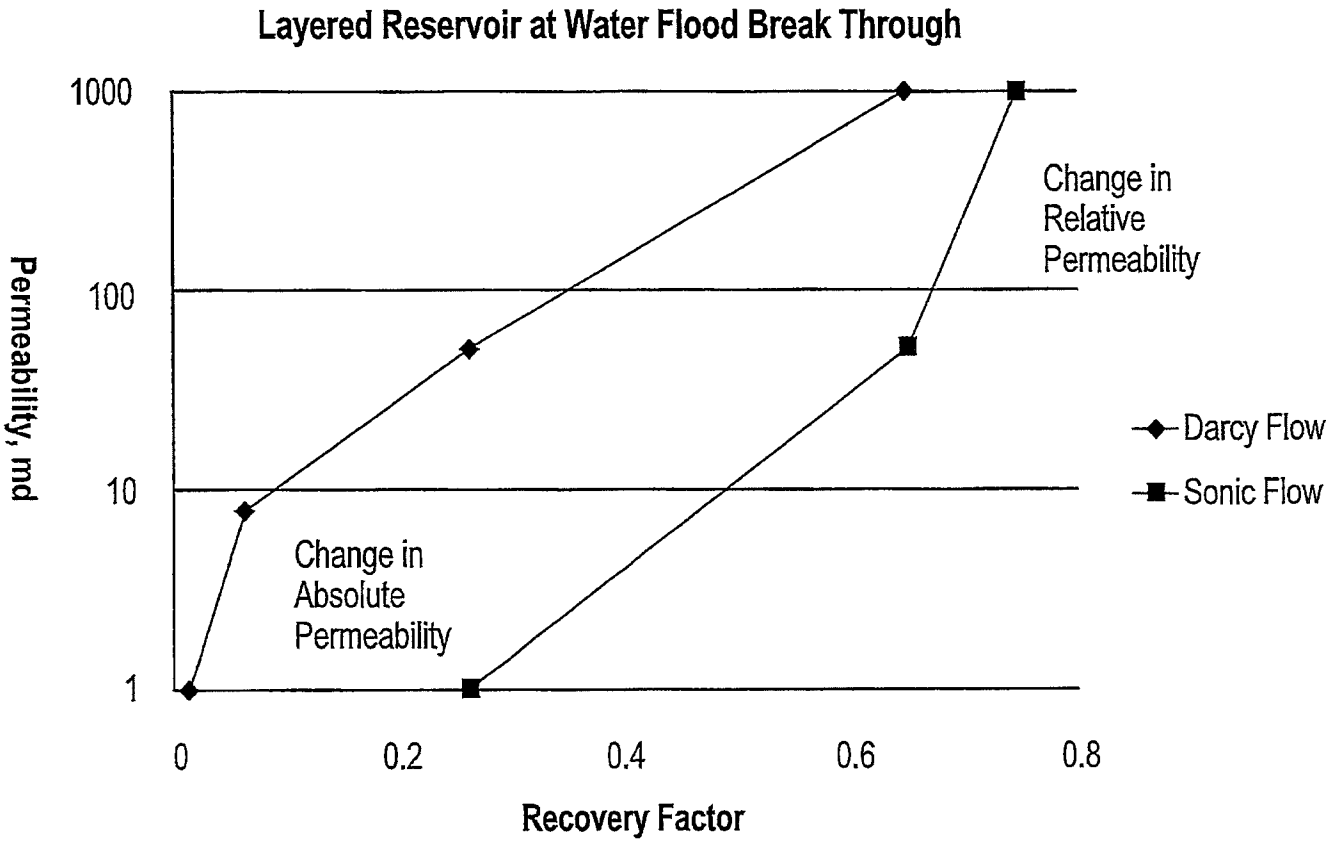
FIG. 7 is a graph of the modeled results of a layered reservoir showing the effects of acoustic stimulation on oil recovery factor at the water flood breakthrough of the highest permeability layer.

As shown in FIG. 7, the increase in recovery factor of oil for high permeability layers is due to changes in relative permeability. Thick sandstone reservoirs that are intermediate or oil wet can greatly benefit from acoustic stimulation. The increased recovery factor of oil for low permeability zones is due to increase in absolute permeability of the zone. The vertical sweep in a water injection well would greatly benefit from acoustic stimulation because all the layers would have a more uniform injection profile. Another added benefit is that the scale build up in the well bore is continuously cleaned during sonic stimulation.

Figure 8:
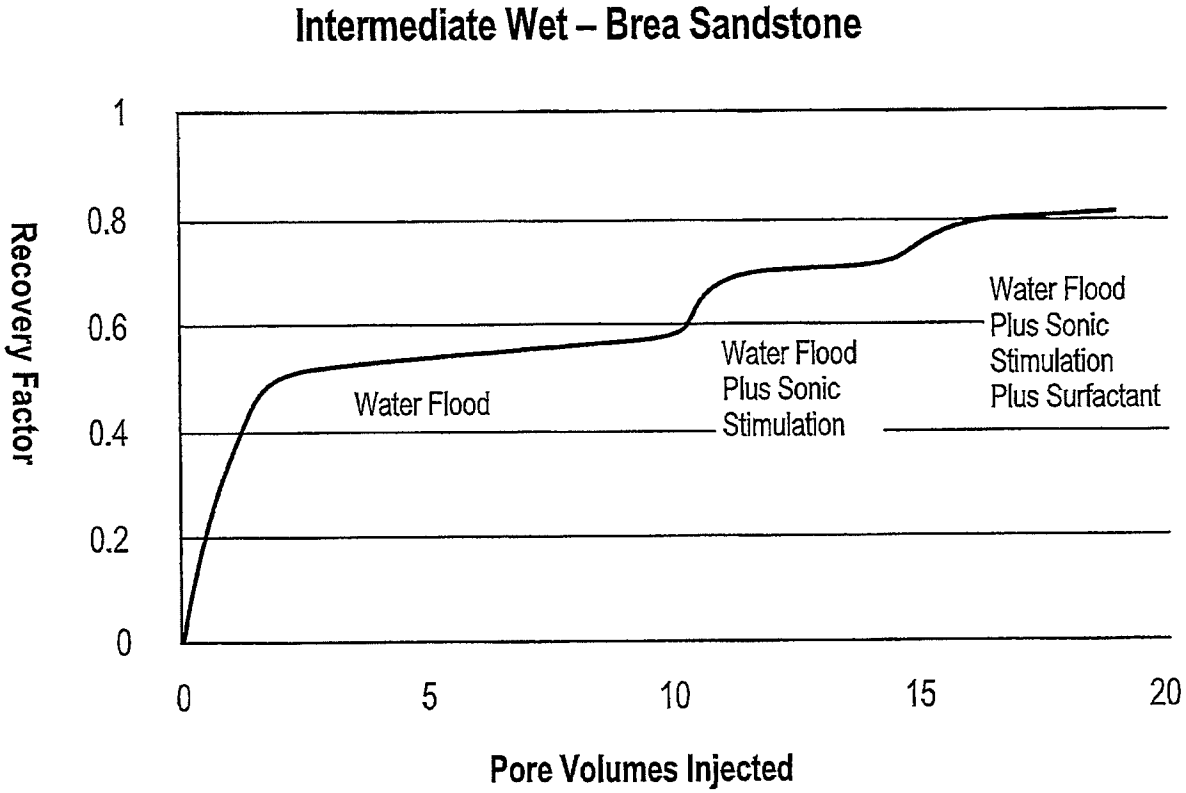
FIG. 8 is a graph of the core flood results showing the recovery factor after a water flood break through and with acoustic simulation of water flood after break through and flooding with water and surfactant with acoustic simulation.

FIG. 8 shows a typical water flood core test for an intermediate wet rock. The ultimate recovery factor for a water flood is about 59% at 10 pore volumes injected. At 99.8% water cut, the core was stimulated with an acoustic sweep of 100 to 120 Hz. The recovery factor increased to 71% at 99% water cut with three incremental pore volumes injected. Then, the water surface tension was reduced with a surfactant and flooded to 99% water cut and the recovery factor was increased to 81% for 6 incremental pore volumes injected. Core tests were repeated with ten pore volumes injected for a water flood followed by surfactant only and the ultimate recovery was 69% at sixteen total pore volumes injected. Intermediate wet core tests show that sonic stimulation increases recovery by an average of 11% of original oil in place over a typical water flood with three incremental pore volumes injected. Oil-wet core tests show that sonic stimulation increases recovery by an average of 25% of original oil in place over a typical water flood with three incremental pore volumes injected.

Figure 9:
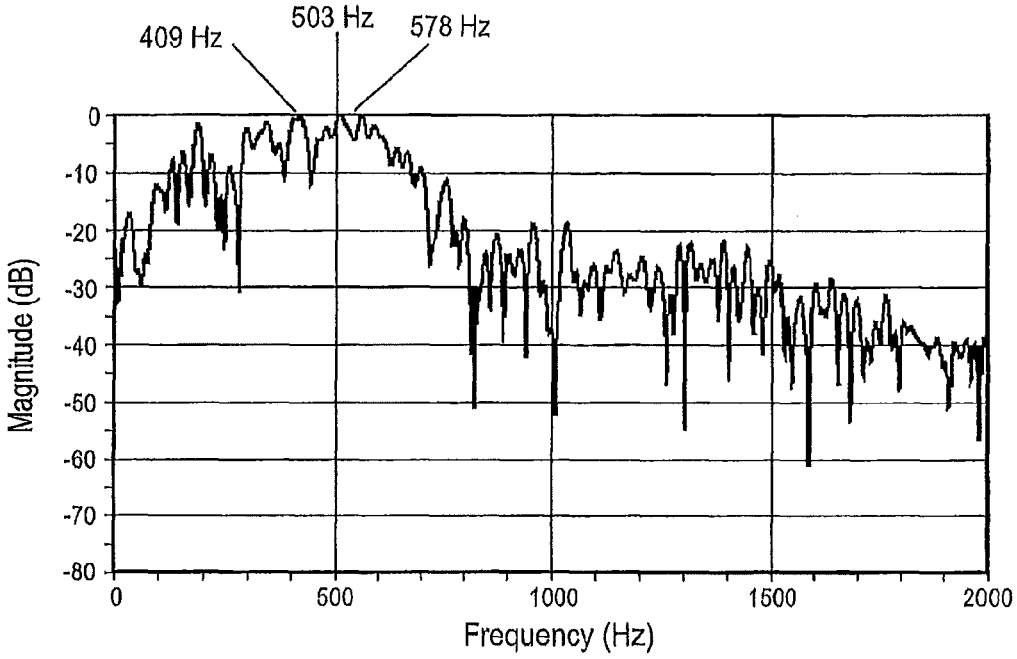
FIG. 9 is a graph a Fourier Transform for a few traces of a guided slow compression wave or tube wave in a packet in a sand-shale layer sequence.

For sequences of thin sandstone, siltstone, shale and/or limestone layers, there are multiple guided wave frequencies measured at the receiving well as shown in FIG. 9. Notice there are only three major troughs at 65 Hz, 270 Hz and 710 Hz which means a significant amount of acoustic energy is leaking from one layer to another and traveling to the receiver well. For the example in FIG. 9, the acoustic source will need to sweep from 350 to 600 Hz to cover the entire resonate frequency band. To overcome the acoustic energy loss to bounding layers, sonic stimulation sources can be installed in closer than normal proximity to each other.

Figure 10:
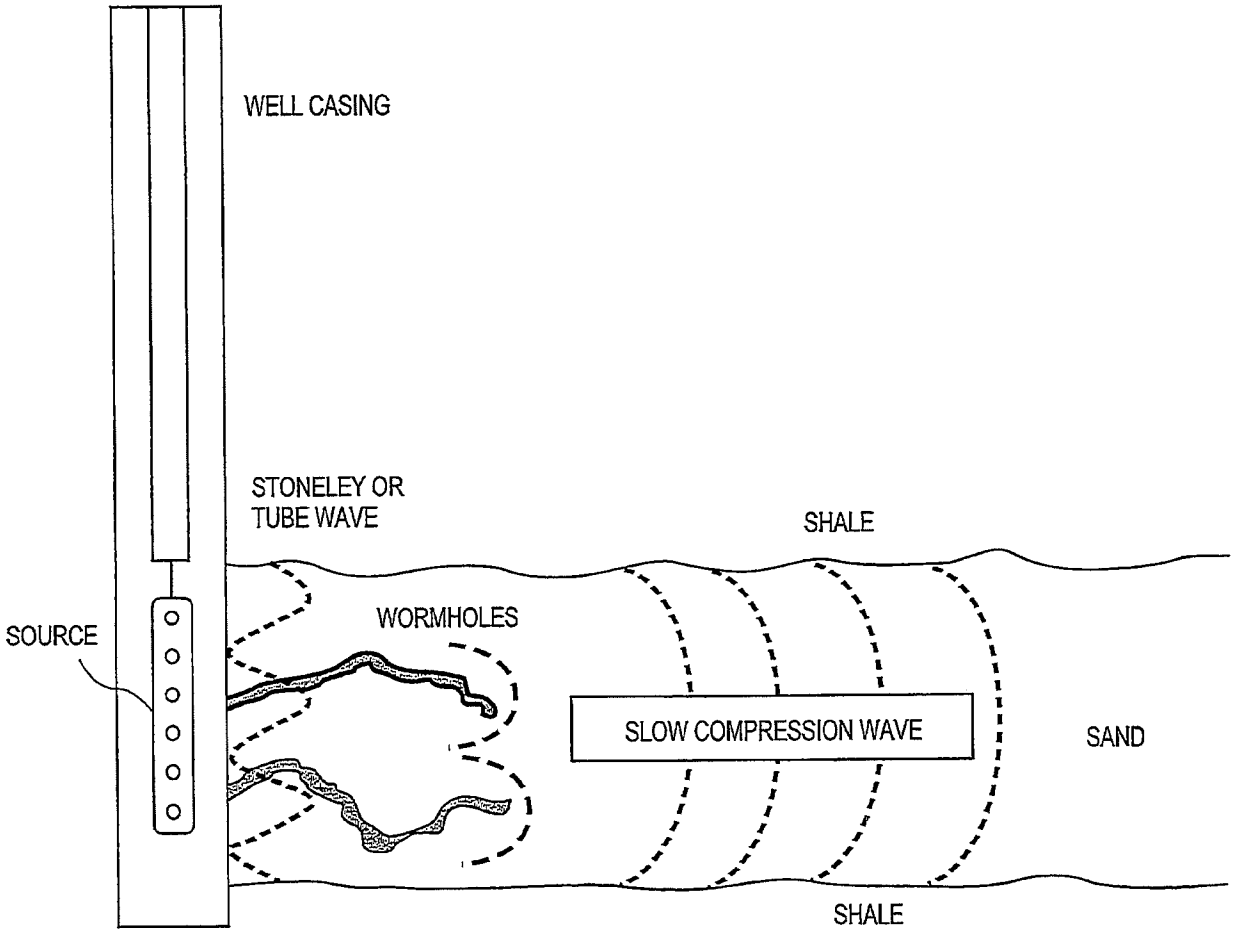
FIG. 10 is a cross-sectional view of a heavy oil production well with a sonic tool placed across the formation.

FIG. 10 shows a production well with a sonic source stimulating a heavy oil production zone. Large perforations and a progressive cavity pump are used to produce the heavy oil to the surface along with the entrained sand. The sand production creates worm holes in the formation which in turn provide channels to drain the heavy oil to the production well. Stoneley waves generated in the well bore will create resonant tube waves in the worm holes. The resonant tube wave will fluidize the sand in the channel and keep the wormhole growing into the formation. The resonant tube wave will also reduce the heavy oil viscosity by a factor of 2 to 2.5 in the channel, thus reducing pressure loss around the near well bore area.

Figure 11:
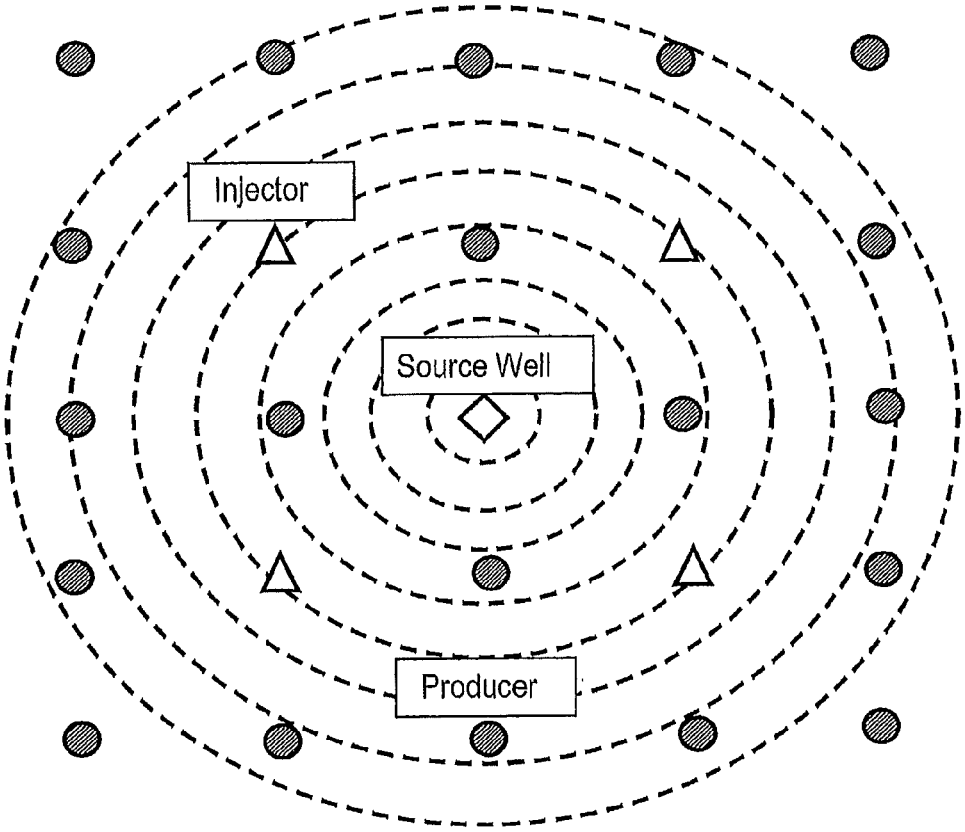
FIG. 11 is an aerial view of a 9-spot pattern under a water, a steam, a surfactant, or a carbon dioxide flood.

FIG. 11 demonstrates a typical 9-spot water injection pattern using the water injector in the middle of the pattern as a sonic source well. However, a production, an injection or a dedicated well could all serve as sonic source wells. The source spacing will depend on the guided or slow compression wave attenuation in the oil reservoir determined from cross well bore tomography or calculation from sonic logs. The solid dots represent production wells while the open triangles represent water injection wells. To augment the oil recovery achieved with sonic stimulation, the surface tension of the water can be reduced by removing hardness or adding surfactant.

Figure 12:
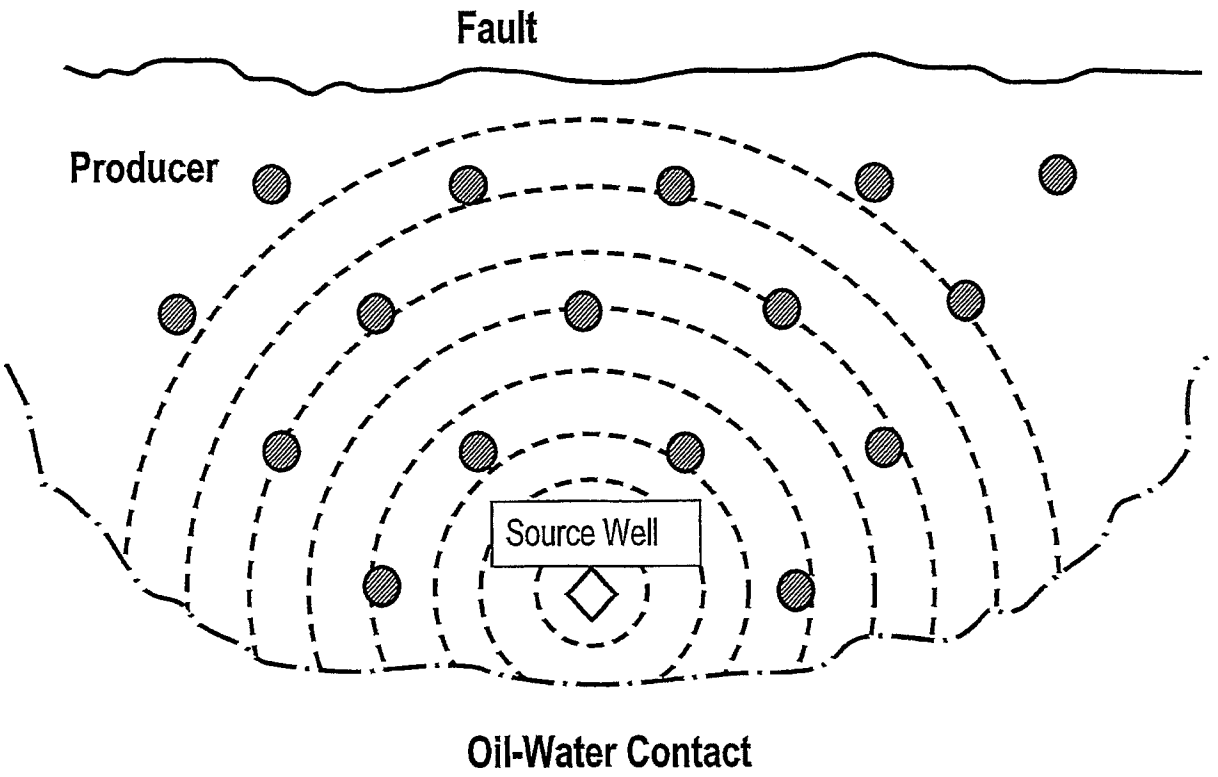
FIG. 12 is an aerial view of a natural water drive reservoir against a fault in which the sonic source well is located between the oil-water contacts and the faults.

FIG. 12 is an illustration of a field where a sonic stimulation pilot test was actually performed. This is a natural water drive field with layers dipping away from the fault and the fault itself splitting a gentle anticline. The oil accumulated at the top of the gentle anticline. The field was developed with the natural water drive and produced to 99% water cut or 1% oil cut. A sonic stimulation tool was installed in a production well and the oil cut increased from 1% to 8% in a producing well near the sonic source and farther away the oil cut increased to 4%. Wells more than 1200 ft away showed no increase in oil cut. The central frequency of the tool was 350 Hz based on cross well bore tomography analysis of the guided waves and the tool was swept between 300 and 400 Hz.

Figure 13:
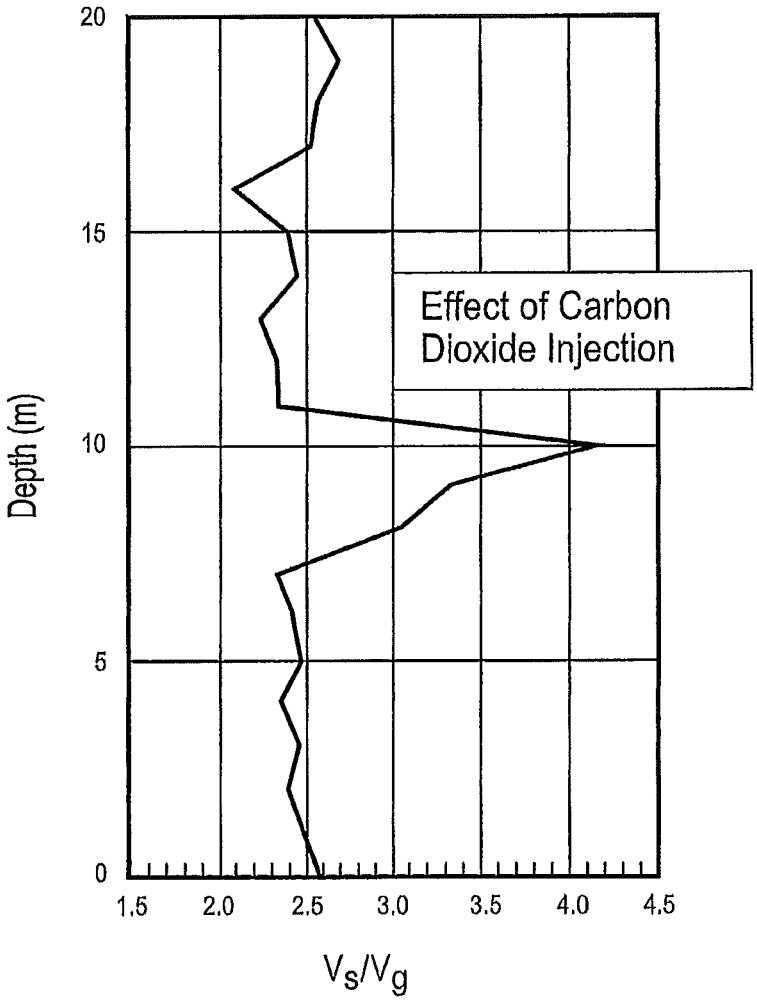
FIG. 13 is a graph of an average velocity ratio of a first arrival shear wave versus a first arrival slow compression wave of a zero offset cross well bore tomography image of a carbon dioxide flood.

FIG. 13 shows the effect of carbon dioxide on the slow compression wave velocity. As carbon dioxide swells the oil and makes a second liquid phase, the compressibility of the liquid increases and the viscosity of the liquid decreases. Both of the effects slow the compression wave velocity below the velocity of water in the reservoir. Sonic stimulation will increase gravity segregation between the carbon dioxide phase and the oil phase and enhance top-down carbon dioxide flooding in patterns with thick productive zones.

Figure 14:
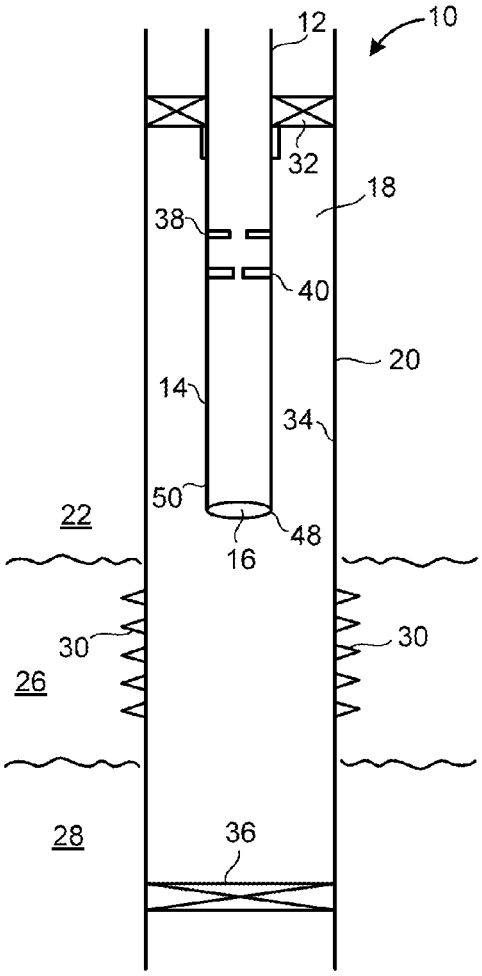
FIG. 14 is a cross-sectional view showing the preferred embodiment of the sonic oil recovery apparatus of the present invention as positioned within a well.

FIG. 14 illustrates the sonic oil recovery apparatus 10 of the present invention. The sonic oil recovery apparatus 10 includes an injector tubing 12 and a resonator tube 14. The resonator tube 14 is affixed to or located within the injector tubing 12. The resonator tube 14 has an interior flow pathway 16 so as to allow a fluid to flow therethrough from the injector tubing 12. The resonator tube 14 is suitable for transmitting an acoustic signal of greater than 30 Hz therefrom. Preferably, the acoustic signal will be between 600 Hz and 1800 Hz.

As can be seen in FIG. 14, the injector tubing 12 and the resonator tube 14 have been placed within the interior 18 of a well casing 20. The well casing 20 extends downwardly through a shale formation 22 so as to have a portion 24 positioned within a sandstone formation 26. The sandstone formation 26 will be defined between the shale portion 22 and another shale portion 28 located below the sandstone formation. The casing 20 has perforations 30 formed through a wall thereof in the targeted oil formation of the sandstone 26. As such, the fluid passing through the flow pathway 16 of the resonator tube 14 can flow through the perforations 30 for the purposes of enhanced oil recovery.

A packer 32 is affixed to the outer surface of the injector tubing 12 (or affixed to the exterior surface of the resonator tube 14) so as to engage with the inner wall 34 of the casing 20. As such, the packer 32 serves to isolate the annular area above the resonator tube 14. The packer 32 can also be used so as to transmit longitudinal and shear vibrations to the casing 20. A bridge plug 36 is positioned below the target oil formation 26 and extends across the diameter of the casing 20. The bridge plug 36 serves to reflect fluid vibrations back to the acoustic stimulation interval. In order to enhance the transmission of the longitudinal and shear vibrations, it was found that cuprum nickel is the optimum material.

In FIG. 14, it can be seen that the resonator tube 14 has a pair of orifice plates 38 and 40. Although more orifice plates could be utilized within the concept of the present invention, experiments with the present invention have indicated that the optimum amount of energy is achieved with just two orifice plates. If more than two orifice plates are used, there tends to be more noise in the acoustic signal. Each of the orifice plates 38 and 40 has orifices that are coaxially aligned. The orifice plates 38 and 40 are separated by less than one inch.

As can be seen in FIG. 14, the orifice plate 38 has an orifice of a greater diameter than that of the lower orifice plate 40. Additionally, the orifice plate 38 has a thickness that is less than the thickness of the orifice plate 40. Experiments with the present invention have indicated that differing thicknesses between the orifice plates 38 and 40 produce a better signal. The basis for this improved signal is not fully understood. However, there appears to be some quality associated with resonance that is achieved when the orifice plates have different thicknesses. Additionally, the orifice plates 38 and 40 should have a thickness of greater than 3/16 of an inch. If the orifice plates are too thin, then they will tend to flex and lose energy by vibration. In FIG. 14, the orifice plate 38 will have a thickness of 1/8 inch and the orifice plate 40 will have a thickness of 1/4 inch.

The resonator tube 14 is installed below the packer 32. The resonator tube 14 is a Helmholtz resonator with an open end 48. This open-ended resonator tube 14 is used when the resonate frequencies of the tubing and casing closely match the resonate frequencies of the target formation 26. The guided wave is contained within the sandstone 26 and is being reflected off of the bounding shale layers 22 and 28. The bridge plug 36 is used to reflect fluid vibrations back to the active acoustic stimulation interval. The resonator tube 14 has an extension tube 50 extending below the orifice plates 38 and 40 of the Helmholtz resonator. The length of this extension tube can be changed in order to fine tune the resonate frequency of the tubing and lower the resonate frequency of the casing fluid pulsation.

Figure 15:
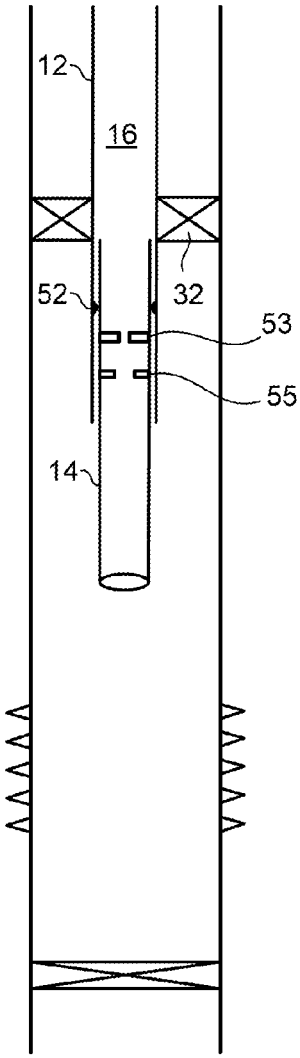
FIG. 15 is an alternative embodiment of the sonic oil recovery apparatus as shown in FIG. 14 and showing, in particular, the positioning of the resonator tube within the interior of the injector tubing.

FIG. 15 further shows that in this alternative embodiment that there are a pair of orifice plates 53 and 55. It can be seen that the orifice plates 53 and 55 have differing thicknesses. The upper orifice plate 53 has a thickness that is greater than the lower orifice plate 55. Orifice plates 53 and 55, in this embodiment, are separated by less than 1/2 inch. In this embodiment, the orifice plate 53 has an orifice that is a smaller diameter than the orifice associated with the orifice plate 55.

As used herein, the term "orifice plate" is used to describe the various plates positioned within the interior of the resonator tube 14. However, various other configurations, other than plates, are envisioned within the concept of the present invention. As such, this term should be construed so as to interpret any type of nozzle.

The Helmholtz resonator utilizes vortex instability in the exiting stream of an upstream orifice plate to impact the edge of the downstream orifice plate. The vortex impact generates the acoustic pulse within the interior of the resonator tube 14. The acoustic pulse returns back to the upstream orifice plate to generate anew vortex. The vortex requires a finite distance to fully develop uniformity around the stream. For a smooth concave orifice shape with one to three lobes, the minimum distance for a uniform vortex is 1.0 to 1.2 the effective orifice diameter. The fully developed vortex will dissipate into random turbulent flow by seven effective nozzle diameters. However, the effective downstream distance ranges from 1.2 to 5.6 effective orifice diameters. As the developed vortex travels downstream, it grows as it entrains more fluid and finally dissipates into turbulent flow as it entrains too much fluid mass to spin at the stream core velocity. In order to maximize the acoustic pulse amplitude, the downstream orifice plate should cut the vortex where the fluid is moving perpendicular to the stream axis. The downstream nozzle should range 1.1 to 1.4 times the upstream nozzle diameter. The maximum acoustic power for a single Helmholtz resonator is generated with a downstream nozzle located to 2 to 3 upstream nozzle diameters downstream. For a multiple orifice Helmholtz resonator, the downstream nozzle is located 1.2 to 2 times the effective upstream diameters downstream with an effective nozzle diameter of 1.1 to 1.2 times the effective diameter of the preceding upstream nozzle. Each downstream resonator works with a slower stream velocity as the effective orifice diameter increases. When four Helmholtz resonators are used, the first two resonators could resonate at a higher frequency than the last two resonators. The Strouhal number ($w=f\pi D/U_0$) for this Helmholtz resonator design ranges from two to three. The sets or orifice plates can be designed to resonate at different frequencies.

Figure 18:
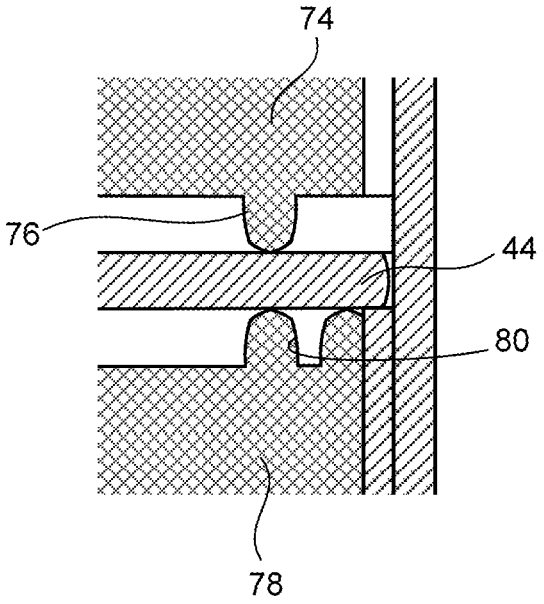
FIG. 18 is a cross-sectional detailed view showing the relationship of the spacers with respect to the orifice plates.

FIG. 18 illustrates the details of the spacers in relation to the orifice plate 44. As can be seen, a spacer 74 is positioned on top of the orifice plate 44. Spacer 74 has a contact point 76 which extends vertically downwardly from a surface thereof so as to contact the upper surface of the orifice plate 44. Similarly, there is another spacer 78 which has a contact point 80 extending vertically upwardly so as to contact the under surface of the orifice plate 44.

Figure 19:
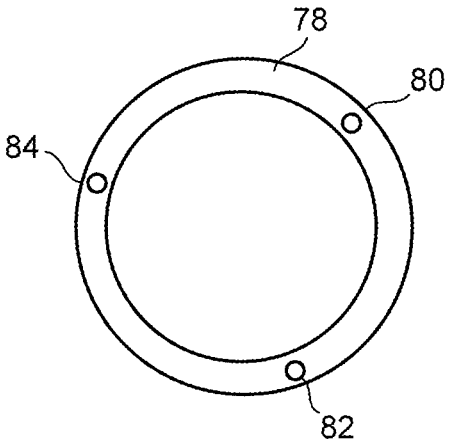
FIG. 19 is an isolated plan view of a spacer as used in the present invention.

FIG. 19 shows a single spacer 78. Spacer 78 is shown as having contact points 80, 82 and 84 arranged approximately 120° apart. As such, the spacer 78 will maintain contact with the orifice plate 44 at three points. Because of the use of these contact points 80, 82 and 84, the acoustic feedback loop is through the fluid and not through the body of the orifice plate. The resonator body material is usually metallic because polymeric material (or other soft material) absorbs a significant amount of the acoustic power.

Figure 16:
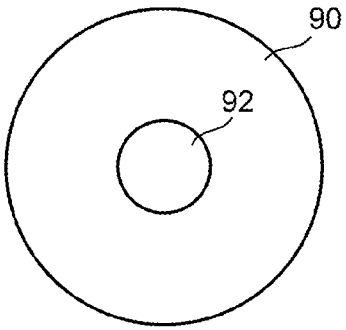
FIG. 16 is a plan view of an orifice plate as used in the preferred embodiment of the present invention.

FIG. 16 illustrates the configuration of one type of orifice plate 90. Orifice plate 90 has a generally annular configuration having a central orifice 92 formed therein. The circular orifice 90 would be considered to be of a "single lobe" design. The orifice plate 90 is the easiest orifice plate to manufacture and will have the least amount of wear surface. The effective diameter of this orifice 92 is the actual diameter of the orifice 92.

Importantly, the orifice plate 90 must have an ultra-smooth edge around the orifice 92. The orifice 92 is milled into the orifice plate 90 and then smoothed with by precious stone standing. It is very important to have smooth edges on the orifice plate since turbulence can be created by unsmooth or jagged surfaces.

The orifice plates, as used in the present invention, will have smooth radiused edges to promote uniform vortex generation along the nozzle stream. Sharp edge shapes, such as triangles, would cause uneven vortex generation. As such, it would not lock-in to a frequency as well as the smooth edge nozzle shapes, as described herein.

Figure 17:
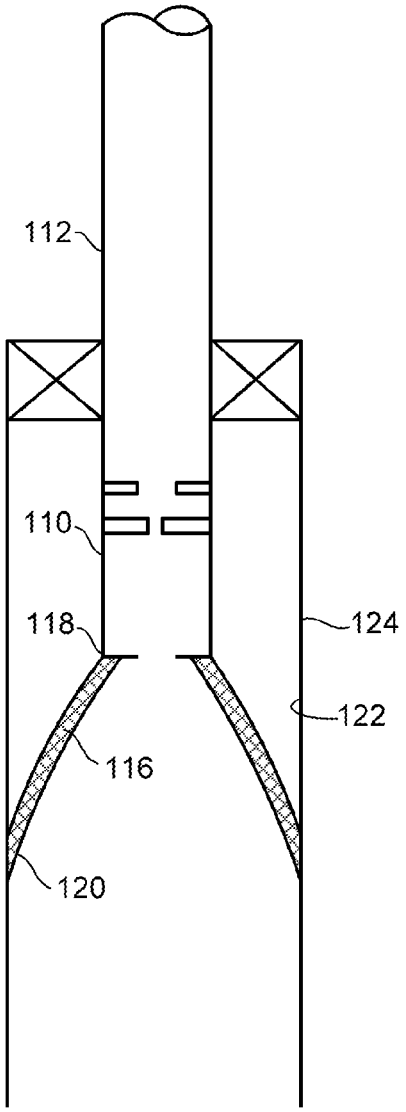
FIG. 17 is a cross-sectional view showing a further alternative embodiment of the present invention in which a frustoconical trumpet section extends downwardly from the resonator tube and outwardly therefrom.

FIG. 17 shows an alternative embodiment of the present invention. In particular, the resonator tube 110 will be connected with the injector tubing 112. The Helmholtz resonator 114 is illustrated as positioned within the interior of the resonator tube 110. Importantly, a frustoconical member 116 is affixed to the lower end 118 of the resonator tube 110 so as to have a narrow diameter at the end 118 and a wide diameter 120 generally adjacent the inner wall 122 of the casing 124. Frustoconical member 116 acts as a transition nozzle on the exit of the Helmholtz resonator. This serves to maximize the generation of tube waves in a horizontal injection well. The frustoconical member 116 will smoothly expand the acoustic pulse from the diameter of the resonator tube 110 so as to match the casing inner diameter in the injection well.

With reference to FIG. 14, it can be seen that there is a packer 32 and a bridge plug 36 that are used to confine the acoustic pulse to the target area. It is possible that the bridge plug 36 would not be required since fill may eventually accumulate in the area of the bridge plug 36. If the acoustically-stimulated interval is over three wave lengths long, then a significant amount of the acoustic pulse energy will be converted to a tube wave in the casing. Openhole intervals do not have as much energy loss because the rugosity of the hole helps to prevent tube wave generation. The problem of tube wave generation is that the tube wave frequency rarely matches the guided wave frequency of the oil formation. For hydraulically-driven acoustic sources, it is more efficient to perforate the interval with at least six shots per foot with diminishing returns beginning at twelve shots per foot.

For oil production wells, hydraulically-driven acoustic sources could be difficult to use because there may not be enough room in the well bore for the production tubing and the hydraulic power tubing. For brine injection wells, the hydraulic power for the acoustic source is generated from the injected brine.

Figure 20:
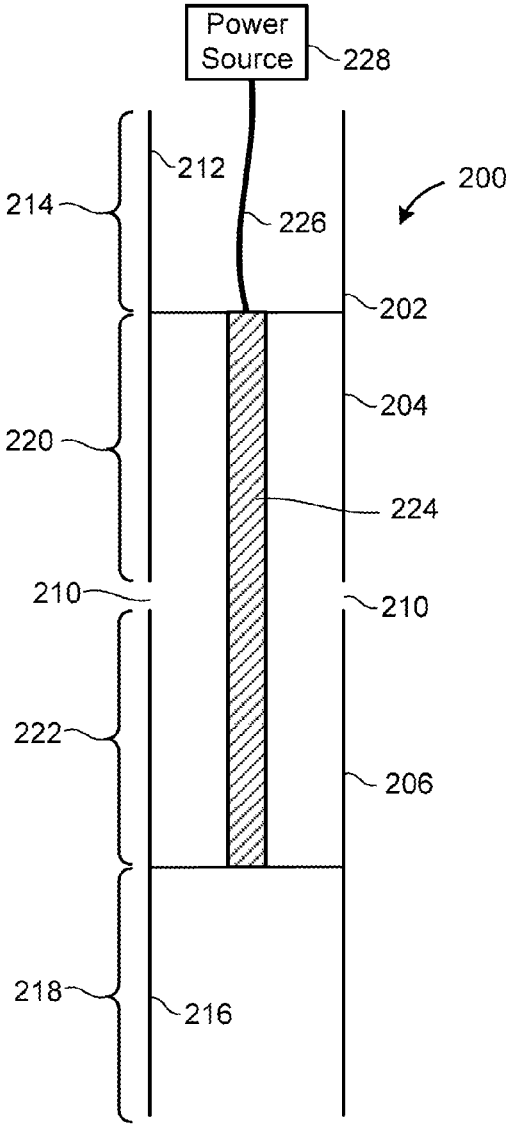
FIG. 20 is a cross-sectional view showing a further alternative embodiment of the present invention in which a solid state acoustic resonator is used.

FIG. 20 shows another alternative embodiment of the present invention. In FIG. 20, there is shown a solid state acoustic resonator 200. The solid state acoustic resonator 200 is based upon an opposing one-half wave length organ pipe design. In particular, the resonator tube 202 has a first pipe 204 and second pipe 206 with outlet 208 opening continuously therebetween. The use of holes instead of the outlet 208 would not function properly, as the pulse would travel to the adjacent pipe rather than exiting the resonator 200. Each pipe 204 and 206 will generate an acoustic pressure pulse in the fluid flowing therethrough. Each pulse travels the length of the pipes 204 and 206 and crashes into the opposing acoustic pulse. The crash combines both pulses together and reflects them perpendicularly through the outlet 208. The solid state design allows acoustic levels to exceed 200 decibels.

In particular, there is an upper section 212 that will receive one-half wave (illustrated by bracket 214). A lower section 216 will also receive a one-half wave (illustrated by bracket 218). Brackets 220 and 222 illustrate the one-half wave within the particular pipes 204 and 206. The outlet 208 will be a one-twentieth wave opening.

The solid state acoustic resonator 200 is suitable for tube wave generation. This design is used for horizontal wells where the tube waves are continuously removing some form of near well bore damage. This damage could include asphalting, build up, deposition, fines migration, oil emulsion viscosity reduction and bitumen viscosity reduction. The generator 200 operates to enhance ore pile permeability and gravity drainage.

The driver 224 will extend through the pipes 204 and 206. The driver 224 is connected by line 226 to a power source 228. The driver 224 can be of a magneto restrictive material or a piezolelectric material. Magneto restrictive materials require a high amperage of electrical power from the power source 228. The piezolelectric material would require a high voltage electrical power from the power source 228. Usually, three-phase AC electrical power is converted to the properly pulsed DC source downhole in order to reduce electrical line losses.

Figure 21:
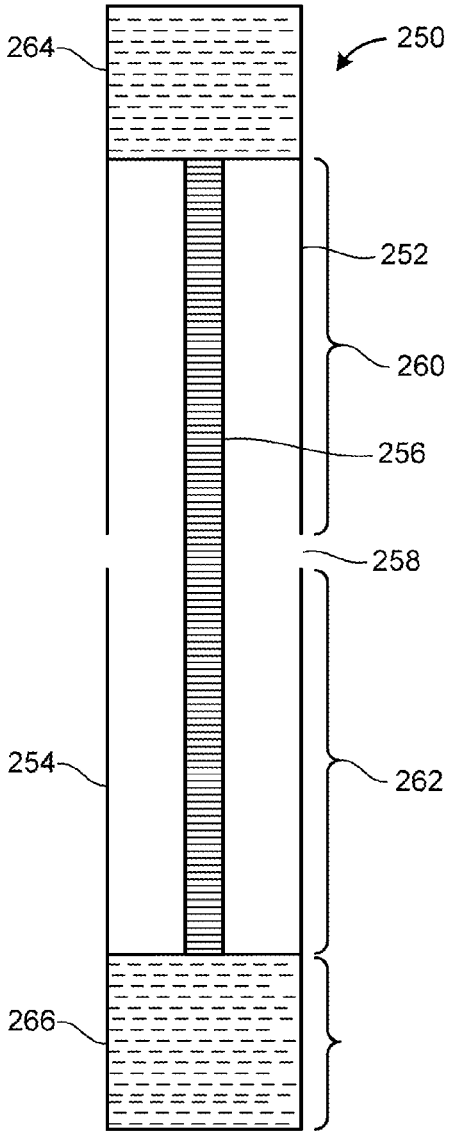
FIG. 21 is an illustration of a solid-state acoustic resonator with a one-half wave length slotted closed end tube.

FIG. 21 illustrates a further modification of the solid state acoustic resonator 250 of the present invention. The acoustic resonator 250 includes pipes 252 and 254 that have the driver 256 extending therethrough. A one-twentieth wave opening 258 is defined between the pipes 252 and 254. As such, the one-half waves 260 and 262 will crash into each other and reflect perpendicular to the tool face. FIG. 21 shows a one-quarter wave length perpendicular slotted closed end tubes 264 and 266. The closed end tube 264 is located at the end of pipe 252. The closed end tube 266 is located at the end of pipe 254. Each of these tubes 264 and 266 are suitably slotted so as to suppress the tube wave generation. Tube waves would mask important cross well bore tomography signals used to determine average oil saturation and flood cross location. The driver 256 will have a similar configuration to the driver 224, as described in FIG. 20.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A sonic oil recovery apparatus for use in a well having a casing therein, the apparatus comprising:

an injector tubing adapted to extend within an interior of the casing; and a resonator tube affixed to or within said injector tubing, said resonator tube having an interior flow pathway so as to allow a fluid to flow therethrough from said injector tubing, said resonator tube suitable for transmitting an acoustic signal of greater than 30 Hz therefrom, said resonator tube having at least two orifice plates formed therein.

2. The apparatus of claim 1, said plurality of orifice plates arranged in generally spaced relationship to each other, said plurality of orifice plates having respective orifices arranged in coaxial relationship.

3. The apparatus of claim 2, said at least two orifice plates having an upper orifice plate and a lower orifice plate, the orifice of said upper orifice plate having a diameter greater than a diameter of the orifice of said lower orifice plate.

4. The apparatus of claim 1, said resonator tube having no more than two orifice plates.

5. The apparatus of claim 1, one of said the orifice plates having a thickness different than a thickness of another orifice plate.

6. The apparatus of claim 1, said at least two orifice plates comprising:

a first orifice plate; and a second orifice plate spaced by a first distance from said first orifice plate, said first orifice plate positioned above said second orifice plate.

7. The apparatus of claim 1, each of said at least two orifice plates having an outer diameter between 1.2 and 5.6 times a diameter of the respective orifice thereof.

8. The apparatus of claim 1, said at least two orifice plates arranged in spaced parallel relationship to each other, said resonator tube having at least one spacer positioned between adjacent pairs of said at least two orifice plates.

9. The apparatus of claim 8, the spacer comprising an annular member having a contact point extending vertically therefrom, said contact point suitable for contacting a surface of the orifice plate.

10. The apparatus of claim 1, said at least two orifice plates being spaced by no more than one inch from each other.

11. The apparatus of claim 1, the acoustic signal being between 600 Hz and 1800 Hz.

12. The apparatus of claim 1, each of said at least two orifice plates having a thickness of no less than 3/16 inch.

13. The apparatus of claim 1, said resonator tube having a frustoconical member extending from a bottom thereof, said frustoconical member having a narrow diameter at said bottom of said resonator tube, said frustoconical member having a wide diameter suitable for positioning adjacent an inner wall of the casing.

14. The apparatus of claim 1, said resonator tube having a tubular extension extending downwardly therefrom, said tubular extension positioned below said at least two orifice plates.

15. The apparatus of claim 14, said tubular extension having a plurality of exit holes extending radially through a wall of said tubular extension adjacent said at least two orifice plates, said tubular extension having a closed end opposite said at least two orifice plates.

16. The apparatus of claim 1, said resonator tube received interior of said injector tubing and extending outwardly beyond a lower end of said injector tubing, and apparatus further comprising:

a landing nipple interposed between an outer surface of said resonator tube and an inner wall of said injector tubing.

17. The apparatus of claim 1, further comprising:

a packer affixed to an outer surface of said injector tubing, said packer suitable for engaging with an inner wall of the casing, said packer positioned above said resonator tube.

18. The apparatus of claim 1, said resonator tube suitable for transmitting an acoustic signal approximately equal to a resonant frequency of the well formation.

19. The apparatus of claim 1, said resonator tube having a solid state acoustic resonator therein, said acoustic resonator having an electrical power supply connected thereto.

20. The apparatus of claim 19, said solid state acoustic resonator being of a material selected from the group consisting of a magneto restrictive material and a piezolelectric material.

* * * * *